United States Patent [19]

Lancaster

[11] 3,935,820

[45] Feb. 3, 1976

[54] APPARATUS FOR THE IDENTIFICATION OF MOVING UNITS

[75] Inventor: Dean Lancaster, Lakewood, Colo.

[73] Assignee: Control Electronics Corporation, Golden, Colo.

[22] Filed: Aug. 5, 1974

[21] Appl. No.: 494,459

[52] U.S. Cl. ..... 104/88; 246/34 R

[51] Int. Cl.[2] ..... B61J 3/00

[58] Field of Search ..... 104/88; 246/2 F, 63 A, 246/122 R, 34 R; 307/108; 343/6.5 SS

[56] References Cited

UNITED STATES PATENTS

| | | | |
|---|---|---|---|
| 3,077,164 | 2/1963 | DaRoza | 104/88 |
| 3,086,121 | 4/1963 | Cockrell | 104/88 |

FOREIGN PATENTS OR APPLICATIONS

| | | | |
|---|---|---|---|
| 1,206,925 | 9/1970 | United Kingdom | 343/6.5 SS |

*Primary Examiner*—Trygve M. Blix
*Assistant Examiner*—Reinhard J. Eisenzopf
*Attorney, Agent, or Firm*—Van Valkenburgh, Lowe & Law

[57] ABSTRACT

To identify a moving car for switching it from a main line to a spur, a signal indicator on the car tuned to a selected frequency activates a signal pickup apparatus which is located on the main line ahead of the spur. The signal pickup apparatus emits a radiation field sweeping a range of frequencies including the same frequency as that of the signal indicator. The signal pickup apparatus includes circuitry which responds to the activation by the signal indicator to operate the switch of the spur for the diversion of the moving car.

9 Claims, 8 Drawing Figures

Fig. 1

APPARATUS FOR THE IDENTIFICATION OF MOVING UNITS

This invention relates to means and apparatus for the identification of a moving unit, and more particularly to apparatus for the identification and selective diversion, or other subsequent handling, of a moving unit.

The invention is useful in connection with a railway switching system wherein railroad freight cars are diverted from a main line onto a group of spur tracks; however, such cannot be limitative because there exists a number of other analogous conveying systems where moving units are individual cars which move along a fixed course, such as a main track, as into a warehouse, to be diverted to any of several spur tracks to various locations in the warehouse. Also, the act of diversion, as herein described is not limitative, because the invention can be used otherwise, for a different purpose, such as operating an apparatus to count cars moving past a given station. A switching system is described herein to exemplify the invention and a primary object of the invention which is to identify a car as it moves to a switching area or into a warehouse and to effect actuation of switching controls to divert the car to a proper selected spur.

The general operation of an identification and diversion control as outlined above is not inherently new and various manual, mechanical and mechanical-electrical systems have been proposed to accomplish the same result. Perhaps the most sophisticated system known to applicant resides in the use of magnetic-responsive reed switches to direct various signal combinations into a computer which will then direct the moving units past a given control station to their proper diversion spurs. A number of objections have been encountered with the present systems. With a mechanical system, the problem resides in the need for making some sort of contact between the moving car and a pickup station on the main track. While actual contact is not necessary with a reed switch system, the reed switches must be located so that the switches and magnets will be close as the car passes the pickup station. In such systems, it has been found that due to unpredictable circumstances, the reliability of identification and proper diversion is not good and there exists a need for a more reliable system for such an operation.

With the foregoing and other considerations in view, the present invention was conceived and developed and comprises, in essence, an apparatus for the identification of moving cars approaching a switching area or moving into a warehouse which has a signal indicator upon each car tuned to a frequency which is selected for a given spur track to which the car is to be diverted. A signal pickup apparatus at a suitable location on the main track ahead of the spur emits a radiation field through which the signal indicator on the car will pass. The frequency emitted by the signal pickup apparatus varies cyclically and sweeps through a narrow range of frequencies sufficient to include the frequency of the signal indicator with due and reasonable allowance for normal tuning variation of both the indicator and the pickup apparatus. Accordingly, when the car moves past the signal pickup apparatus to place the signal indicator in the radiation field, resonance will occur whenever the swept frequency becomes the same as the frequency of the signal indicator to thus momentarily distort the radiation field. The distortion of the radiation field produces a change of voltage in the signal pickup apparatus which is then converted into a pulse, there being two such pulses for each sweep cycle of the radiation field. Thus, a pulse train is formed and the pulse train passes through discriminating circuits which will eliminate all other kinds of disturbances or distortions of the radiation field. This train of pulses is then used to produce a signal which will actuate the switch of the spur to properly divert the car.

Such a diversion system can be used where there exists a comparatively large number of spurs, for the frequency range to be swept by any signal pickup need be only a small portion of the radio frequency range available and it is estimated that as many as a hundred spurs can be serviced by such an apparatus.

In installing this identification apparatus, it also becomes necessary to consider the nature of the systems which move the cars. In a warehouse operation as herein first described, each car is individually propelled as where a track actually consists of a slot in the floor of the warehouse with the chain drive underneath this slot moving the individual cars through a circuit. In such an arrangement, each signal pickup apparatus may be located closely adjacent to the spur switch to be signalled by any cars designated for that spur, but to permit other cars to move therepast. In a railway operation, also briefly described herein, a string of railroad cars is pushed into the switching yard by an engine and the end car of the string is to be first diverted to its switching spur and the next car thereafter diverted and so on. Thus, it is necessary to locate the signal pickups ahead of the switching system and use an interlock mechanism interconnecting the several pickups to permit the operation of only one switch at a time.

It follows that another object of the invention is to provide in an apparatus for the identification and selective diversion of moving cars, a signal indicator which may be placed upon an individual car for signalling a switching system to properly divert the car, which is a simple, low-cost item, which can remain with the car after the car is unloaded and returned to its point of origin for reloading and reshipping.

Another object of the invention is to provide in such apparatus, a signal indicator which can be quickly and easily tuned to different frequencies to divert a car to any selected spur of a rail switching system.

Another object of the invention is to provide a novel and improved signal pickup apparatus which may be associated with a spur of a switching system and which can respond to a properly tuned signal indicator on a car to permit the car to be diverted to the spur.

Another object of the invention is to provide a novel and improved pickup apparatus capable of sensing the presence of a properly tuned signal indicator which is capable of continuous, reliable operation over long periods of time without incurring maintenance problems.

Other objects of the invention are to provide in an apparatus for the identification and selective diversion of moving units such as railroad cars, a neatly packaged arrangement of components which is simple, economical and reliable.

With the foregoing and other objects in view, my invention comprises certain constructions, combinations and arrangements of parts and elements as hereinafter described, defined in the appended claims and illustrated in preferred embodiment in the accompanying drawings in which:

Figure 1:
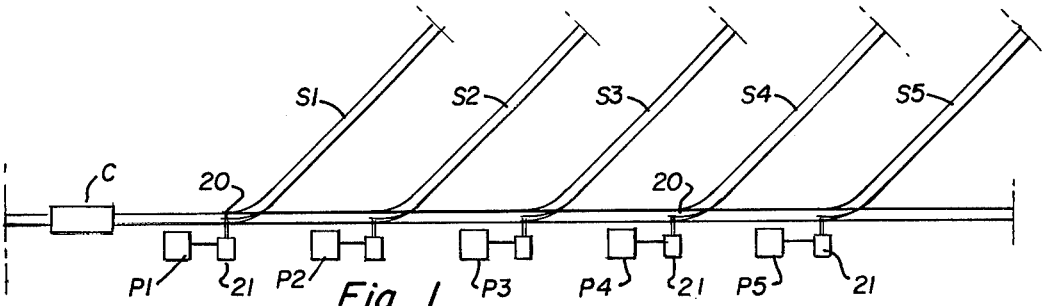
FIG. 1 is a schematic plan view showing a rail section wherein a group of spurs are provided for the diversion of a car from the main rail, and with the improved pickup apparatus arranged for individual moving cars and exemplified in the system by block diagrams.

Referring more particularly to FIG. 1 of the drawing, a number of spur tracks S1, S2, S3, S4 and S5 divert from a main track T. Thus, when a car C on the main track T approaches a spur, it may be diverted thereto by operation of a track system 20. Such a switch may be manually operated but in the present invention it is contemplated that the operation will be by an electrical actuator. The switch and the switch actuator 21, shown in the drawing as a simple box, are conventional and need not be further described.

In accordance with the present invention, each car C will have a tuned signal indicator I mounted upon it, at its side or underneath it, in any suitable manner to permit the indicator I to pass through radiation fields generated by signal pickup units P which are located adjacent to the spur switches as shown at FIG. 1. The pickup units are shown at FIG. 1 as block diagrams P1, P2, P3, P4 and P5 in correspondence with the spurs S1 to S5, respectively. Each pickup unit P will emit a radiation field tuned to cyclically vary within a selected frequency range as hereinafter described, with one of the pickup units P and a selected indicator I being tuned to correspond with each other. Thus, when the pickup unit P is activated by the selected indicator I, as the car approaches the spur switch 20, it will, in turn, activate the spur switch actuator 21 to shift the switch to divert the car. When individual cars are moved down the main track T to the proper spurs for their diversion, the pickup units may be adjacent to their corresponding spurs as in the arrangement shown at FIG. 1. However, whenever a number of cars are attached together and the end car is to be diverted first by moving all of the cars until diversion actually occurs, it becomes desirable to place all pickup units P in a group ahead of the spur switches 20 and to provide an interlock between the individual pickups so that whenever the signal indicator on an end car moves past its proper pickup, the interlock will prevent other cars of the string from signalling their pickups, as hereinafter further described.

Figure 4:
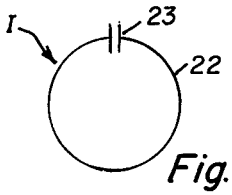
FIG. 4 is a view of a simple signal indicator which may be tuned to a selected frequency.

The signal indicator I, in the present invention, comprises a comparatively simple circuit which is tuned to resonate at a selected frequency. As shown at FIG. 4, this indicator I may be a simple wire loop 22 with a capacitor 23 in the circuit. The size of the loop and the capacitance of the capacitor will establish the desired resonant frequency. If necessary, the wire may be looped several times, to form a simple coil. It is contemplated that an individual indicator will be used for each car and the individual indicators will be tuned differently to selectively correspond with different pickups P.

Figure 5:
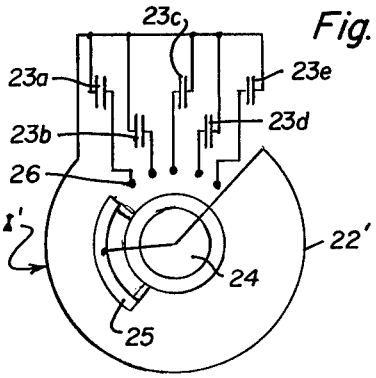
FIG. 5 is a circuit diagram of another type of signal indicator which is arranged to be set to different frequencies.

A more elaborate signal indicator may be provided which can be tuned to different frequencies. On one trip, a car may be diverted to a selected spur, such as the spur S1, but on the next trip it will be diverted to a different spur, requiring a differently tuned indicator. The arrangement at FIG. 5 shows one mode of providing a variable signal indicator I′ for this purpose. One end of a circuit loop 22′ is connected to a group of capacitors **23*a*, 23*b*, 23*c*, 23*d* and 23*e* in parallel, while the other end of the loop 22′ is connected to an adjusting knob 24. The knob 24 carries a sweep 25 connected to the circuit to engage a sequence of contacts 26** to the capacitors to place selected capacitors in the area in parallel in the circuit.

Other variations are possible in the construction of a signal indicator. For example, the circuit may be modified by using a plurality of loops 22 and an arrangement for tuning the signal indicator to different frequencies is possible by using a switch which can include one or more loops of a multiloop coil. A further modification of this arrangement is also possible where both a plurality of circuit loops is used and a plurality of capacitors is used with switches at both the circuit loops and at the capacitor to tune in any selected number of loops and a selected number of capacitors in an arrangement similar to that shown at FIG. 5.

Figure 2:
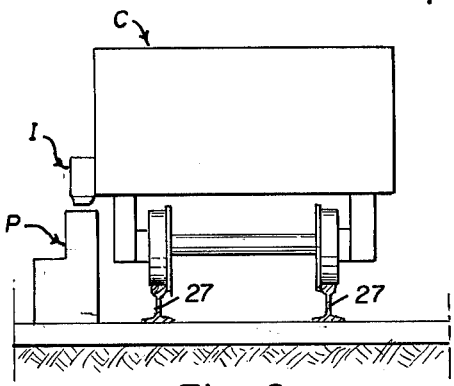
FIG. 2 is a schematic transverse view of a car upon rails showing one mode of mounting a signal indicator thereon and its position with relation to a pickup apparatus as it moves past the pickup apparatus.
Figure 3:
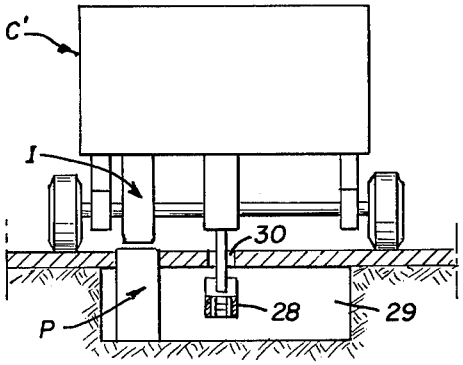
FIG. 3 is a diagrammatic transverse view of another type of car wherein the guide rail consists of a slot in the floor of a warehouse with a car driving mechanism beneath the floor and with a signal indicator arranged to move past a pickup apparatus at the floor level thereof.

The signal pickup P, as hereinafter further described, includes a radiation coil R, through which an oscillating current is passed to produce a radiation field. The pickup, or at least the coil R, is mounted alongside the track, for the radiation field must be within the influence of the indicator I which is carried upon the moving car. The indicator I and the pickup P need not contact each other, but as a practical matter, one should be reasonably close to the other to minimize the necessary strength of the radiation field and render it more susceptible to disturbances such as that created by the indicator I. Arrangements for mounting the signal indicator and the pickup P are illustrated at FIGS. 2 and 3 in a somewhat diagrammatic manner. FIG. 2 represents a car C mounted upon rails 27 with the indicator I attached to the side of the car and a pickup P mounted alongside the car as within a container which is directly underneath the indicator I. The radiation coil R will be in the container adjacent to the indicator I.

FIG. 3 represents a warehouse car C′ which is driven by a chain 28 in a cavity 29 underneath a guide slot 30 in the floor of the warehouse. In this arrangement, the pickup P may be located in the cavity beneath the floor of the warehouse and the indicator I may extend from the underside of the car to be near the pickup P whenever the car moves past it.

Figure 6:
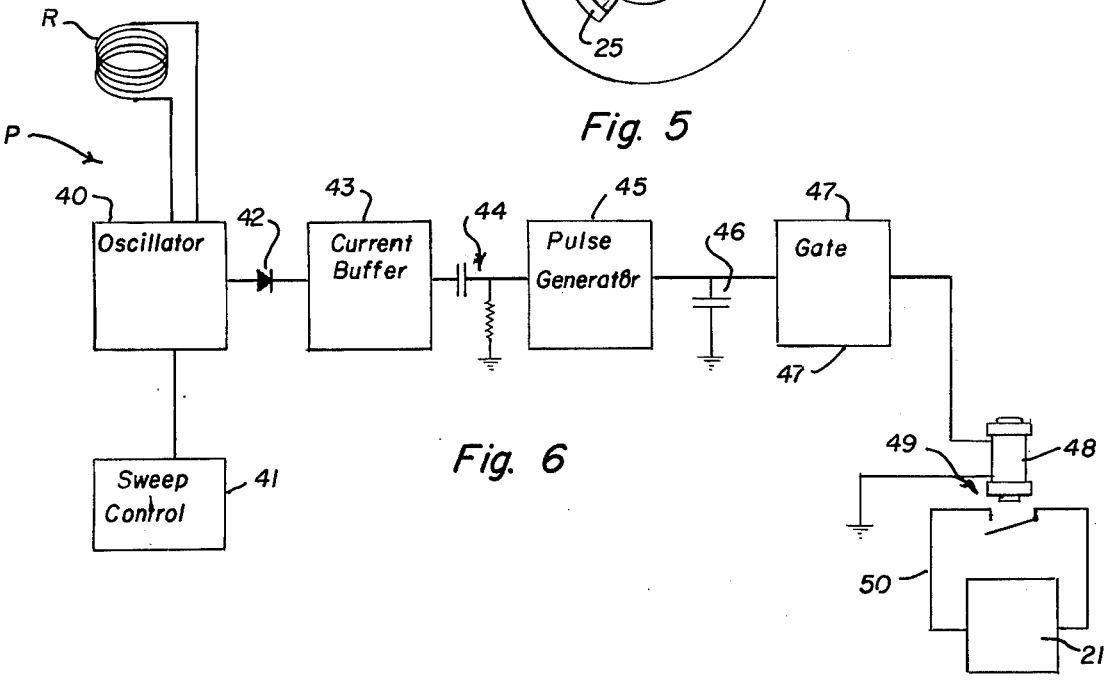
FIG. 6 is a block diagram of the components forming the pickup apparatus.

The basic components of a circuit system which can function as a pickup P are indicated at FIG. 6. The radiation coil R is adapted to be energized by an oscillator 40. The oscillator will be of a grid dip type, wherein a disturbance of the radiation field of the coil will produce a voltage change in its circuits. Such a voltage change can be caused by an indicator I which is turned to the same frequency as the oscillator frequency. It is well known that such an oscillator 40 will also respond in a similar manner, by a voltage change in its circuit, the block of metal and the like, the difference being that the indicator I will cause the voltage change to occur only at its resonant frequency and a block of metal or the like will cause the voltage change to occur at all frequencies.

Thus, to differentiate the signal, the voltage change in the oscillator circuits, produced by a signal indicator I from a similar signal produced by a block of metal, the frequency emitted by the oscillator 40 is cyclically varied from a selected base frequency by a sweep control 41 at a frequency which may be one-hundreth to one-millionth of the base frequency. It follows that the frequency of the radiation field will be the same as the resonant frequency of the signal indicator I for a short period of time twice during each cycle of variation and the voltage of the oscillator 40 will pulse at such times, to dip or rise depending upon the circuit arrangement. These repeated voltage pulses will not occur when the disturbance is by a block of metal, or the like, and thus, the pulses may be used to distinguish an indicator I from a block of metal or the like which would produce a steady voltage change in the oscillator.

This mode of recording the presence of the pickup indicator I in the field is advantageous in that it is unnecessary to have either the indicator I or the pickup P tuned to a high degree of precision. This is important because, whenever the indicator or pickup does not have to be tuned with a high degree of precision the cost of producing the equipment can be drastically reduced. For example, the indicator may be tuned to resonate at a frequency which is ± 1 percent of a selected base frequency, or it may be tuned to resonate at a frequency which is ± 5 percent of the selected base frequency.

In any event, it is essential that the frequency range through which the pickup sweeps must be greater than the frequency deviation which is permitted in the indicator. For example, if the indicator I is tuned to within ± 1 percent of a selected base frequency, the frequency range through which the pickup P will sweep could be ± 2 percent of the base frequency, or if the indicator I is tuned to within ± 5 percent of the base frequency, the frequency range through which the pickup P will sweep could be ± 10 percent of the base frequency. To select a suitable sweep of frequency by the pickup P, not only must an allowance be made for tuning variations of the indicator, but also an additional allowance must be made for variations of the base frequency of the pickup which will include the possibility of drift over the life of the apparatus.

It was found desirable to provide a sweep control 41 to produce a frequency variation in the oscillator field which can be best described as a triangular wave instead of the more common sinesodial wave. It was found that the sine wave characteristic was quite inefficient timewise. Also, other types of sweep characteristics such as a sawtooth wave were found to disrupt the operation because of a spiking action of the wave.

The sequence of momentary voltage pulses in the oscillator 40 which occur whenever the oscillations are at the resonant frequency of an indicator I in the radiation field is the signal which must be used to tell the apparatus that the moving car is to be switched. This signal is thus modified to a more usable form by electronic circuitry. For example, referring to FIG. 6, the signal is first rectified by a diode 42 and the rectified signal is buffered to increase the available current by circuitry indicated at 43. The resultant output is a comparatively steady voltage interrupted by a sequence of pulses. A high pass filter 44 passes only the pulses while the base voltage and any steady state voltage such as that produced by a metal body is eliminated at the filter. Next, the pulses, which are of a short duration and are of varying amplitudes, are modified to square pulses of consistent duration and of a selected voltage in a pulse generator 45.

It is to be noted that some random pulses such as static will also pass through this pulse generator but not as a steady sequence. Accordingly, an energy storage capacitor 46 is provided in the circuit to receive the sequence of pulses produced when the indicator I affects the voltage of the oscillator. The voltage on the energy storage capacitor 46 will rise to a given value through the action of a selected number of pulses to then operate a gate 47 and energize the coil 48 of a relay 49 which, in turn, actuates the relay switch in a circuit 50 to the spur switch operating mechanism 21.

Figure 7:
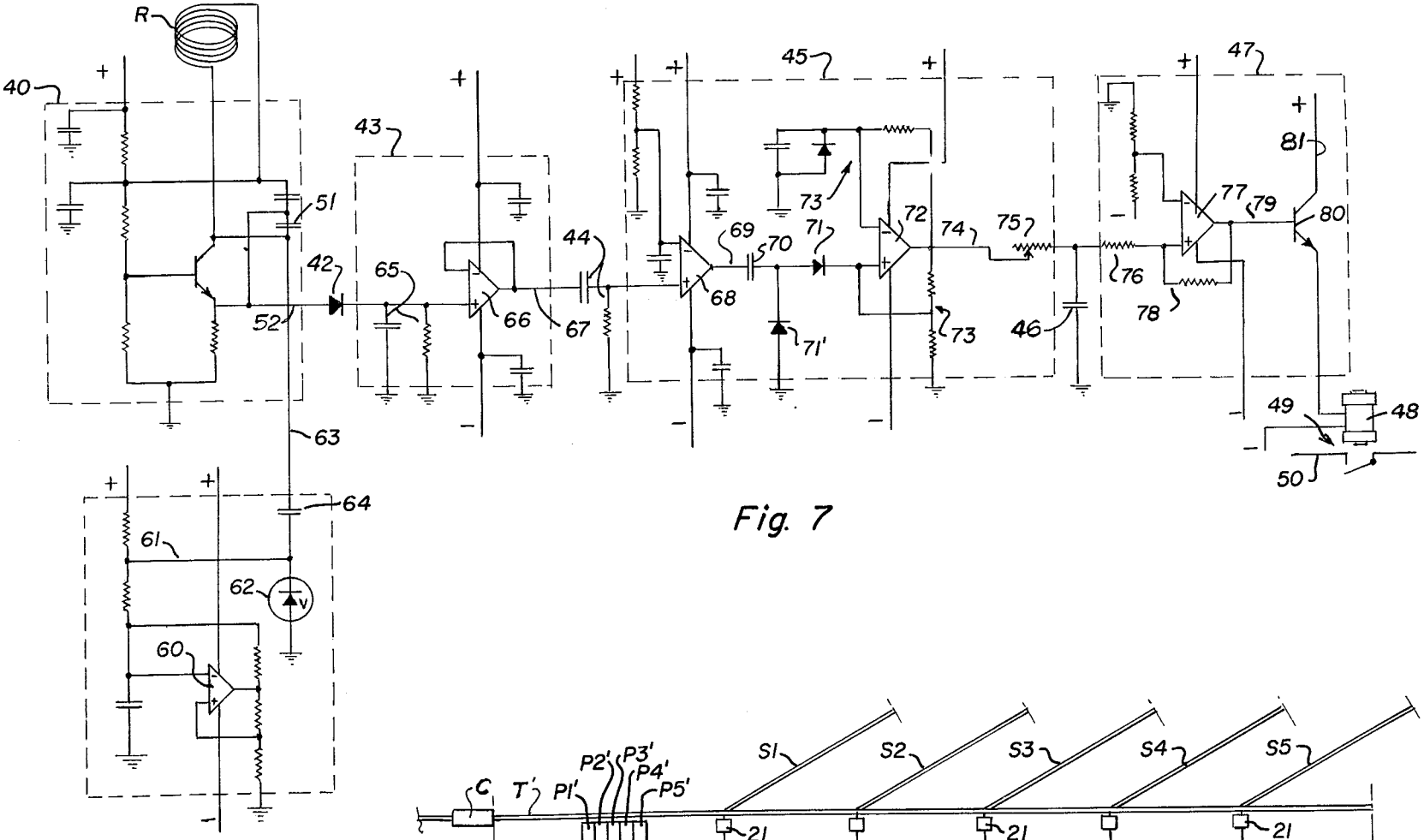
FIG. 7 is a circuit diagram of an arrangement which may be found in the block diagram of FIG. 6.

FIG. 7 shows a circuit having the basic subcombinations of the block diagram shown at FIG. 6 and which is suitable to accomplish the functions described. The oscillator 40 is a conventional Colpitts Oscillator which includes the radiation coil R. Thus, the several components in this oscillator need not be described in detail.

The sweep control 41 is also a feedback oscillator utilizing an integrated circuit amplifier 60 to produce a variable voltage output in the form of a triangular wave. The voltage output lead 61 connects with a tuning diode 62 which functions as a variable capacitor responsive to variation of voltage at the output lead 61. A lead 63 which includes a coupling capacitor 64, extends from the diode 62 to the frequency determining capacitors 51 of the oscillator 40. With the coupling capacitor 64 in this lead 63, the effect of the voltage variation in the sweep control is to produce a capacitance variation in the oscillator 40. The sweep control 41 and the oscillator 40 may be tuned to permit the oscillator to vary from a selected base frequency any selected amount, say for example, 2 percent or 10 percent. To effect a good operation, the frequency of the variable voltage in the sweep control will be substantially less than the frequency of the oscillator and as heretofore noted, it may be from 1/100 to 1/1.000,000 of the value of the oscillator frequency.

Whenever the radiation field of the coil R is disturbed, a voltage drop or a voltage change will occur which can be called a pulse, and as heretofore mentioned, such a pulse will occur each time the frequency of the oscillator is the same as the frequency of an indicator I in the radiation field. This voltage change is picked up at a lead 52 in the oscillator and the lead extends to the diode 42. The diode 42 will receive this pulse output, and whenever an indicator I is in the radiation field the output will be a pulsing voltage signal having a pulse twice during each cycle of frequency variation as above described. This voltage signal, modified by an RC filter 65, formed by a capacitor and a grounded resistance, is directed to an integrated circuit 66 in the buffer circuit 43, which buffers the available current to provide a stronger signal.

The output lead 67 from the operational amplifier 66 connects with the RC filter 44 formed by a capacitor and a grounded resistance. The filter effectively eliminates any slowly changing or steady state voltage signal which could be caused by an action or means other than that produced by the signal indicator. Accordingly, this signal leaving the RC filter will be pulses and will be a sequence of pulses whenever an indicator I is in the radiation field.

The pulses are directed into a gate formed by an amplifier 68 and its associated components, part of the pulse generator 45. The output of the amplifier 68 in the lead 69 is transmitted as a series of pulses which pass through a coupling capacitor 70 in the lead 69. A diode 71 in the lead 69 and a diode 71' extending from the lead 69 to ground forms a steerage circuit for the input of a one-shot multivibrator. The diode 71 passes positive pulses into the multivibrator and the diode 71' provides for discharge of the coupling capacitor. The one-shot multivibrator illustrated in the drawing is a conventional circuit which includes an integrated circuit operational amplifier 72 and its associated components 73. With the circuitry illustrated, the multivibrator forms square pulses of a selected duration and of a selected voltage.

This train of shaped pulses from the output lead 74 of the multivibrator passes through a resistor 75 in the lead to charge the capacitor 46, with each pulse increasing the voltage on the capacitor until a point is reached where the voltage will be sufficient to actuate the gate 47.

The gate 47 includes a control resistor 76 in lead 74 which extends to an operational amplifier 77. The operational amplifier 77 of the gate 47 has a positive feedback loop 78 including resistors 76 and 78 so the gate's turn-off voltage is lower than it's turn-on voltage.

The output lead 79 of the operational amplifier 77 is connected with the base of a transistor 80. The collector and emitter of this transistor are connected with a power lead 81 extending to the relay 48 heretofore described. Thus, whenever the gate turns on responsive to building up a charge in the capacitor 46, the relay 49 is actuated to operate the track spur switch heretofore described.

Figure 8:
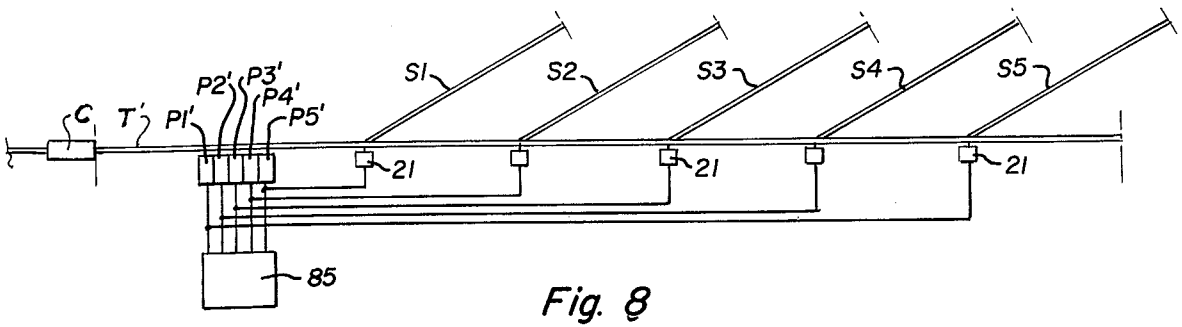
FIG. 8 is a schematic plan view showing a rail section and spurs diverging therefrom wherein the pickup apparatus is arranged for use with a string of cars connected together where the end car in the string is to be diverted first.

FIG. 8 exemplifies a track T' having spurs S1, S2, S3. S4 and S5, as heretofore described. However, the pickups P1', P2', P3', P4' and P5' are modified to function for a system where a train of cars connected together are being switched. It is common for a train to push cars into selected spurs one at a time commencing with the trailing or end car of the train. When the apparatus, an indicator I, is used with each car and each indicator is tuned to resonate at a frequency put out by the radiation field of a selected pickup P to operate a switching control 20, as heretofore described, it becomes necessary to permit only one switching control to operate at a time and the arrangement shown in FIG. 8 permits such operation. All of the pickups are ahead of the switch spurs S. Thus, whenever the train moves past the pickup toward the switches, the end car which is to be first switched will signal its pickup to open the proper spur. These pickups are located close together so that the end car will pass all of them before another indicator on another car moves into position. Accordingly, these pickups are interconnected to an interlock system indicated as a block diagram 85 at FIG. 8. This interlock functions to disable all of the other pickups whenever one of the pickups is activated by the indicator I on the end car. The circuit leads to the switch controls 21 function as heretofore described to operate the switches. The interlock 85 also includes a mechanism which causes the switches to remain in the interlock state with only one switch in operation until completion of the switching operation under way. Thereafter, the mechanism releases the circuitry to permit it to be reactivated when the next car is to be switched. The details of the mechanism and the circuits of the interlock 85 are not described herein since conventional circuits may be used to accomplish the functions described.

From the foregoing description, it is apparent that others skilled in the art can accomplish the same results with other circuits which are equivalent to the circuits described. It is also possible to reverse the apparatus with the indicator I being stationary and with the pickup P being movable. Therefore, although I have described my invention in considerable detail, it is apparent that others skilled in the art can devise and build alternate and equivalent constructions which are nevertheless within the spirit and scope of the invention. Hence, I desire that my protection be limited not by the construction as illustrated, but only by the proper scope of the appended claims.

I claim:

1. An apparatus to identify car units moving along a fixed course for subsequent switching or like purposes, comprising:

a. a signal indicator means on the moving car unit which is tuned to resonate at a frequency which is permitted to vary only by a small percentage from a selected base frequency, b. a signal pickup means adjacent to the fixed course including an oscillator means producing a radiation field which extends to and is within the influence of the signal indicator means whenever the car unit moves past the signal pickup means, c. a sweep control means controlling the frequency of the signal pickup means and cyclically varying the frequency of the radiation field produced by the signal pickup means from the aforesaid selected base frequency through a range of frequencies, above and below the selected base frequency, which is slightly greater than the permitted variation of the resonant frequency of the aforesaid signal indicator from the said base frequency, whereby the signal pickup means will operate at the resonant frequency of the signal indicator means twice during each sweep cycle and thereby whenever the signal indicator means is within the influence of the radiation it causes a repeated distortion of said radiation field and a distortion of the voltage pattern within the signal pickup means, d. a circuit means associated with the signal pickup means to provide a signal and which is responsive only to a repeated distortion of the voltage pattern in the signal pickup means, and e. a control means adapted to be actuated responsive to the aforesaid signal by the circuit means.

2. In the apparatus in claim 1 wherein:

the signal indicator means includes a coil loop and a capacitor in series.

3. In the apparatus defined in claim 1 wherein:

the signal indicator means includes a coil loop, a sequence of capacitors and means for interconnecting the coil loop with a selected capacitor of the sequence whereby to tune the signal indicator means to a predetermined resonant frequency established by the capacity of the capacitor.

4. In the apparatus defined in claim 1 wherein:

the signal indicator means includes a plurality of coil loops, a capacitor and means for interconnecting a selected number of coil loops with the capacitor whereby to tune the signal indicator means to a predetermined resonant frequency established by the selected number of loops and the capacitor.

5. In the apparatus defined in claim 1 wherein:

the signal indicator means includes a plurality of coil loops, a sequence of capacitors, and a means for interconnecting a selected number of coil loops with a selected number of capacitors whereby to tune the signal indicator means to a predetermined resonant frequency established by the aforesaid selected coil loops and capacitors.

6. In the apparatus defined in claim 1 wherein:

the sweep control means varies the frequency of the signal pickup means in a cyclic manner with the frequency variation with respect to time being best exemplified by a triangular wave.

7. In the apparatus defined in claim 1 wherein:

the distortion of the radiation field occurs twice during each cyclic sweep of the sweep control means and wherein the circuit means modifies the voltage of the signal pickup means to produce a sequence of pulses.

8. In the apparatus defined in claim 1 wherein:

the circuit means converts the disturbances into a train of pulses and includes a coupling capacitor and a one-shot multivibrator to shape and size pulses to uniformity, and the further improvement comprising an input steerage circuit between the coupling capacitor and the multivibrator.

9. An apparatus for the identification of a car unit moving on a main track to divert the unit to a selected spur extending from the track and including in combination:

a. a spur switch operating means at the junction between the track and the spur adapted to be actuated to shift the spur switch to divert the car from the main track, b. a signal indicator means on the moving unit and tuned to resonate at a frequency which is permitted to vary only a small percentage from that of the selected base frequency, c. a signal pickup means adjacent to the track ahead of the spur switch juncture including an oscillator means producing a radiation field alongside the track and within the influence of the signal indicator means whenever the car unit moves past the signal pickup means, d. a sweep control means to control the frequency of the signal pickup means to vary the frequency of the radiation field from the aforesaid base frequency through a range which is slightly greater than the permitted variation of frequency than the aforesaid signal indicator whereby the signal indicator means causes a distortion of the radiation field each time the cyclically varying radiation field is at the same resonant frequency as is the signal indicator means, and e. a circuit means responsive only to the repeated distortion of the radiation field while the signal indicator means is in the radiation field to activate a spur switch operating means.

* * * * *